United States Patent [19]

Loos

[11] Patent Number: 4,861,183

[45] Date of Patent: Aug. 29, 1989

[54] OVERLAPPING CONNECTION

[75] Inventor: Horst Loos, Freudenberg, Fed. Rep. of Germany

[73] Assignee: Siegenia-Frank KG, Siegen, Fed. Rep. of Germany

[21] Appl. No.: 114,433

[22] Filed: Oct. 28, 1987

[30] Foreign Application Priority Data

Nov. 3, 1986 [DE] Fed. Rep. of Germany ..... 3637317

[51] Int. Cl.[4] ..... B25G 3/28

[52] U.S. Cl. ..... 403/354; 403/393; 24/669

[58] Field of Search ..... 403/393, 354; 24/666, 24/669, 701, 702

[56] References Cited

U.S. PATENT DOCUMENTS

| | | | |
|---|---|---|---|
| 2,866,246 | 12/1958 | Waldes | 24/669 |
| 3,183,030 | 5/1965 | Schlueter | 24/669 X |
| 3,626,429 | 12/1971 | Toder | 24/669 X |
| 4,368,562 | 1/1983 | Minami | 403/354 |
| 4,642,859 | 2/1987 | Kaiser | 24/669 |

FOREIGN PATENT DOCUMENTS

| | | | |
|---|---|---|---|
| 1951390 | 4/1970 | Fed. Rep. of Germany . | |
| 7702352 | 5/1977 | Fed. Rep. of Germany . | |
| 7935685 | 3/1980 | Fed. Rep. of Germany . | |
| 8121766 | 10/1981 | Fed. Rep. of Germany . | |
| 3414845 | 6/1985 | Fed. Rep. of Germany . | |
| 1061188 | 4/1954 | France . | |
| 2106119 | 4/1972 | France . | |
| 2172633 | 9/1973 | France . | |
| 171477 | 11/1921 | United Kingdom | 24/701 |
| 2010376 | 6/1979 | United Kingdom . | |

*Primary Examiner*—Andrew V. Kundrat

*Attorney, Agent, or Firm*—Blodgett & Blodgett

[57] ABSTRACT

A limitedly shiftable overlap connection between two platelike parts, as between a U-rail and a covering or blocking platelet of connection rod fittings in which the parts can be brought into connection with one another through a simple snap plug coupling without the need for riveting or welding.

8 Claims, 2 Drawing Sheets

OVERLAPPING CONNECTION

BACKGROUND OF THE INVENTION

The field of this invention is the manufacture of structures for overlapping connection between two plate-like parts which are shiftable to a limited degree in relation to one another. It is particularly related to elements such as the U-rails of connecting rod fittings, for example as used in complex window and door hardware, and the associated contact-point covering or "blocking platelets". In such fittings, one of the plate-like parts has an oblong hole adjusted to the intended displacement path, in which the hole is penetrated by a bridging extension of the other plate-like part. The free end of such an extension projects laterally, by means of a collar or band formed by a T-flange section, beyond the longitudinal rims of the oblong hole. Overlap connections of this kind are known and have been disclosed, for example, in DE-GM 77 02 352, in DE-GM 79 35 685, and in DE-GM 81 21 776. In these known connections, the U-rails of connecting rod fittings and associated contact point covering or blocking platelets are constructed of two plate-like parts. One of these has an oblong hole adjusted to the intended displacement path and the other has a bridging extension which penetrates the hole and whose free end laterally projects, by means of a collar or band formed by T-flange section, over longitudinal rims of the oblong hole.

These known overlap connections are expensive to fabricate, however. This is because the limitedly shiftable connection between the two plate-like parts requires a bridging extension which is created by a special fabrication process, usually a riveting or welding process. This, in turn, can usually only be carried out after the the extension has been brought into the necessary engagement or fastening position relative to the top plate-like parts.

In order to carry out the rational mass-production that is usual for such things as connecting rod fittings, the formation of known types of overlap connections involves a considerable manufacturing cost. Therefore, the primary object of the present invention is the elimination of this significant disadvantage.

It is another object of the invention to provide an overlap connection of the kind described which can be formed through a simple insertion without requiring the use of riveting or welding processes.

Another object is to provide a connection of the sort described which is functionally reliable for the intended use.

SUMMARY OF THE INVENTION

The objects of the invention are achieved by the provision of two plate-like parts, the end of one of which is provided with an oblong hole which ends in a transverse ledge (or an enlargement section of the oblong hole) and in which a hook-like constriction within the oblong hole is provided along at least one longitudinal rim. The other plate-like part is provided with a bridging extension having an abutment shoulder associated with the hooklike constriction of the oblong hole. The extension of this second plate-like part is adapted to form the overlap connection by being guided through a mouth opening in the transverse ledge or through the enlarged section of the oblong hole. The hooklike construction gives away elastically to the side and subsequently returns to its basic position. Thus, it undergrips the bridging extension in the manner of a snap catch, automatically limiting the displacement path of the plate-like part.

In the preferred embodiment, both of the longitudinal rims of the oblong hole are provided with such hook-like constrictions, their designs being mirror images of one another. This increases the functional reliability of the overlap connection. More particularly, each constriction consists of a stop shoulder oriented transversely to the longitudinal direction of the oblong hole. An intake flank extends from each stop shoulder to the transverse ledge, (or the enlargement section) the intake flanks diverging between these two points.

The invention further provides that the bridging extension has a T-shaped cross section having a rectangularly restricted necked-in section ledge which is so shaped to be shiftable lengthwise in the oblong hole but resists torsion-like movement when inserted.

The invention preferably provides that the intake flanks diverge sufficiently so that at the mouth opening they are slightly further apart than the width of the necked-in section, while the spacing in the region of the stop shoulder is smaller than the width of the necked-in section.

In one embodiment, the plate-like piece of the overlap connection which has the bridging extension is manufactured in one piece including the extension by metal pressure-diecasting or by plastic injection molding. Alternatively the part can be fabricated in one piece by die stamping out of a pre-cut sheet metal blank.

Most preferably, the plate-like piece containing the bridging extension may be provided on an underside with at least two stud-like elevations on two diagonally opposite corners which act as clamping bodies by simultaneously pressing against the part containing the oblong hole.

BRIEF DESCRIPTION OF THE DRAWINGS

The drawings show several specific embodiments of the invention.

DETAILED DESCRIPTION OF THE PREFERRED EMBODIMENT

Figure 1:
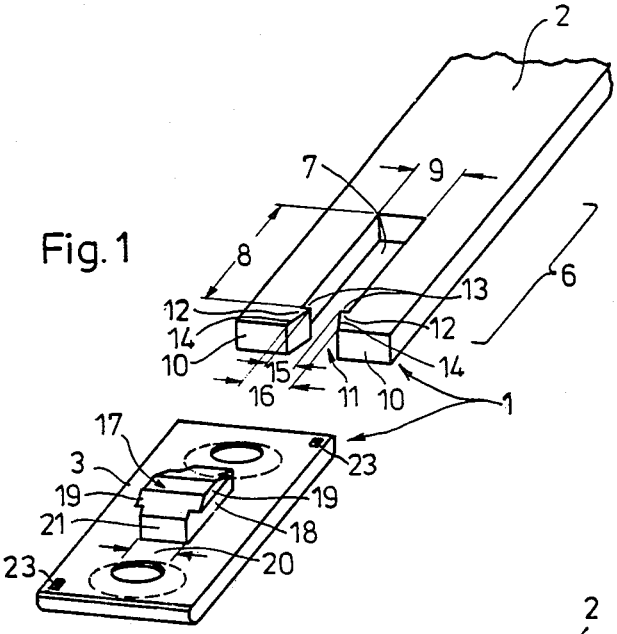
FIG. 1 is a perspective view of the underside of the overlap connection prior to assembly of the two individual parts.

As the drawings show, the overlap connection 1 of the present invention consists basically of two plate-like parts 2 and 3.

In the embodiments shown as examples in these drawings, the first plate-like part forms the U-rail of a connecting rod fitting, such as that on the edge of the wing of a window or door. The second plate-like part is an associated covering or blocking platelet 3 by which the contact point 4 between two U-rails 2 and 5 which lie adjacent in the same plane can be bridged. This is apparent by a comparison of FIGS. 3 and 4. An overlap connection of the kind shown in these drawings may alternately however, be provided in the region of the impact ledges between two relatively thin bodies lying against one another for example, if the combined thickness of the bodies were equal to the thickness of one of the U-rails 2 or 5. Such a connection might be desirable or beneficial, for example, between plastic plates or sheet metal panels.

The first plate-like part (the U-rail 2 in this embodiment) is provided with an oblong hole 7 in the region of the end section 6. The hole has a chosen length 8 and a chosen width 9.

In the embodiments shown through FIGS. 1 through 4, the oblong hole 7 terminates at a transverse ledge 10 of the U-rail 2. At this point, a mouth opening 11 is formed which is limited at both longitudinal rims of the oblong hole 7 by a hooklike constriction 12.

The two hooklike constrictions 12 have mirror image constructions. Each hooklike construction consists of a stop shoulder 12 oriented transverse to the longitudinal direction of the oblong hole 7 and an intake flank 14 which diverges from the stop shoulder to the transverse ledge 12.

The width 15 of the mouth opening 11 between the mutually-facing ends of the stop shoulders 13 is dimensioned considerably smaller than the width 9 of the oblong hole 7. On the other hand, in the region of the transverse ledge 10 of the U-rail 2, the mouth opening 11 displays a width 16 which is at least equal to and preferably slightly larger than the width 9 of the oblong hole 7. The plate-like part of this overlap connection which serves as a covering or blocking platelet 3 can be fabricated as shown in FIGS. 1–4 as a shaped part by metal pressure diecasting (for example, zinc pressure casting) or by plastic injection molding. In either case, a bridging extension 17 extends off on its underside in a longitudinal direction from the cover or blocking platelet 3. This extension 17 has a generally T-shaped cross section or projection consisting of a necked-in section 18 which projects a right angles from the underside of the covering or blocking platelet 3. The necked-in section 18 has two mutually parallel longitudinal surfaces and preferably its profile has a rectangular delineation. Two T-flanges 19 extend from opposite sides of the recked-in section at a point spaced from the underside of the covering or blocking platelet 3.

The width 20 of the necked-in section 18 of the bridging extension 17 corresponds to the width 9 of the oblong hole 7 in the U-rail 2. In this way, it can be brought into operative connection with the oblong hole and is slidable lengthwise in the hole but resists torsion movement.

The two T-flanges 19 of the bridging extension 17 project laterally over the necked-in section 18 so that they can laterally grasp the longitudinal edges of the oblong hole 7 in the U-rail when the bridging extension 17 is brought into guiding engagement with the hole.

In order to couple the covering or blocking platelet 3 with the U-rail 2, it is merely necessary to guide the bridging extension 17 on the underside of the blocking platelet including its necked-in section 18 into the area of the mouth opening 11 and then to exert a longitudinal force on the covering or blocking platelet 3. In this manner the longitudinal necked-in section 18 contacts the intake flanks 14 which diverge from the two hooklike constrictions 12 to the transverse ledge 10. The ledge presses the constrictions apart within the plane of the U-rail 2 by elastically deforming the sections of the U-rail which limit the oblong hole 7 in the longitudinal direction. When the profile ledge 18 lies completely in the area of the oblong hole 7, the hooklike constrictions 12 return to their original positions because of the elastic forces. Thus, the mutually facing ends of the stop shoulders 13 return to a position slightly spaced from one another. In this position, the stop shoulders 13 of the oblong hole 7 interact with an abutment shoulder 21 which is provided on the necked-in section 18 of the bridging extension 17. This limits the displacement path of the bridging extension 17 within the oblong hole 7 and consequently also the displacement of covering or blocking platelet 3 in the longitudinal direction of the U-rail 2.

Figure 2:
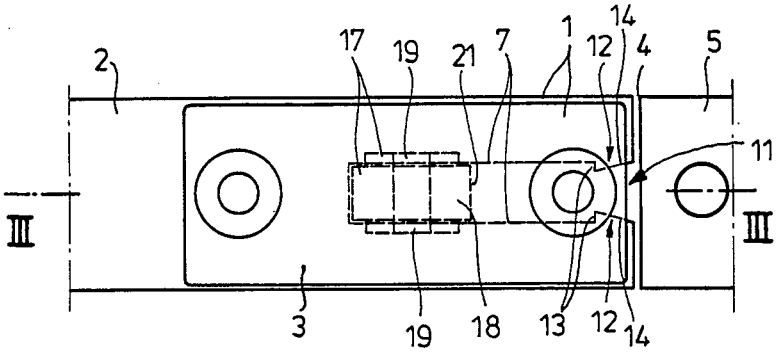
FIG. 2 is a top plan view of the overlap connection after assembly of the two parts.
Figure 3:
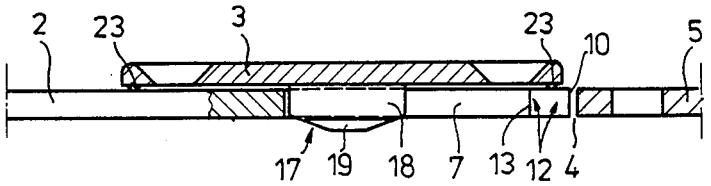
FIG. 3 is a section along the line III III from FIG. 2 through the overlap connection in a first position.
Figure 4:
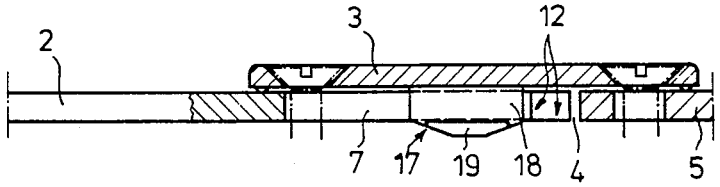
FIG. 4 is a cut corresponding to FIG. 3 through the overlap connection in its second position.

In one displacement end position, the covering or blocking platelet 3 takes up the position relative to the U-rail 2 which is evident from FIGS. 2 and 3. In the other displacement position the relative position is as shown in FIG. 4.

The essential test of the overlap connection of the present invention is that the U-rail 2 and the covering or blocking platelets 3 can be brought into connection with one another through a simple plug mounting; no riveting or welding operation of any kind has to be made.

Figure 5:
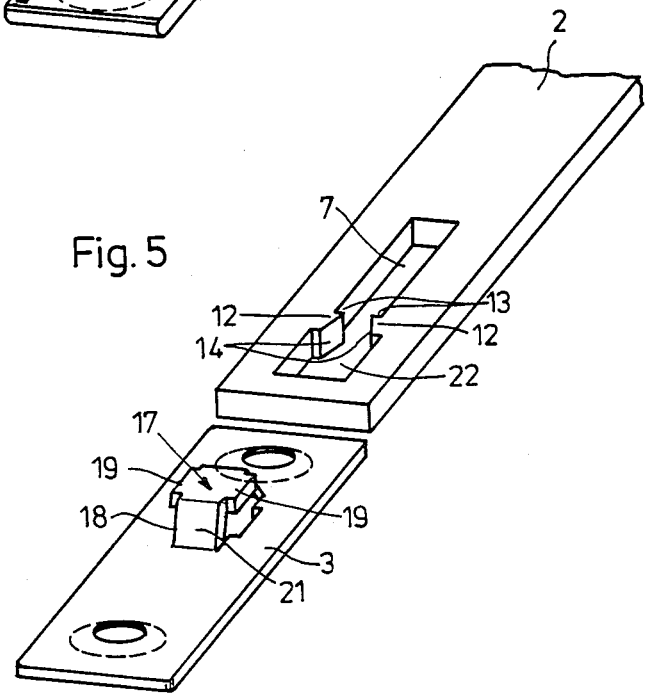
FIG. 5 is a view correspondng to FIG. 1 showing modified embodiments of both the first and second plate-like part, particularly the construction of the oblong hole and the bridging extension.

The construction of an overlap connection 1 according to the present invention as shown in FIG. 5 differs from the embodiment of FIGS. 1–4. It differs first of all in that the mouth opening 11 between the two hooklike constrictions 12 does not run out to a transverse ledge 10 of the U-rail. Instead, an enlargement section 22 is cut into the U-rail 2, separated from the transverse ledge 10. The enlargement section 22 is so designed that the T-flanges of the bridging extension 17 of the blocking platelet can be inserted, transversely, to the plane of the U-rail, within it. Then, as before, the necked-in section 18 of the bridging extension 17 can be inserted into the oblong hole 7 by the exertion of the longitudinal force upon the covering or the blocking platelet 3.

As in the first embodiment, the overlap connection as shown in FIG. 5 can be provided with a blocking platelet which consists of a molded part made from metal pressure casting or plastic injection molding like that shown in FIG. 1. However, it is possible to use a covering or blocking platelet that is constructed as a stamped part from sheet metal. As shown in FIG. 5 the bridging extension 17 may be separated out from the plane of the sheet metal and provided with its necked-in section 18 and the two T-flanges 19 by means of die cuts. The pinion may be formed out over the underside of the sheet metal blank by subsequent stamping pressure.

The interaction of the covering or blocking platelet with the U-rail 2 as shown in the FIG. 5 embodiment does not differ, however, from the covering or blocking platelet according to FIGS. 1–4.

As seen in FIG. 1, the covering or blocking platelet 3 can be provided with a stud-like elevation 23 on at least two diagonally opposite corners on the underside. In the retractive position of the covering or blocking platelet 3, as shown in FIG. 3, when these elevations 23 are simultaneously positioned onto the top of the U-rail 2, a clamping action results from the interaction with the T-flanges 19 of the bridging extension 17. In this simple manner, an undesirable advancing of the covering or blocking platelet 3 relative to the U-rail 2 is counteracted.

As shown in FIG. 4, punched holes can be provided in the covering or blocking platelet 3 for taking up screws which penetrate the U-rails 2. In the operative position of the overlap connection 1 as shown in FIG. 4, a mechanical interlinking of the U-rails 2 and 5 through the covering or blocking platelet is thereby brought about.

I claim:

1. An overlap connection including two limitedly shiftable platelike parts for use in fittings such as U-rails of connection rod fittings and associated contact point covering or blocking platelets in windows, doors, or the like comprising:

(a) a first platelike part having an end which is provided with an oblong hole whose length is chosen to correspond to the intended non-zero displacement path length along which the parts are limitedly shiftable, the oblong hole with parallel sides ending at an enlarged section to form a mouth opening displaying at least one hooklike construction on the longitudinal rim of the oblong hole, the hooklike construction being elastically enlargeable, and (b) a second platelike part having a bridging extension adapted to be inserted in the oblong hole and moved through the length of the hole and having lateral projections on a free end adapted to project over the longitudinal rims of the oblong hole on insertion, the bridging extension having an extended contact area with each of the sides of the oblong hole to give torsion resistance and provided with an abutment shoulder to positively engage with a stop shoulder of the hooklike constriction of the oblong hole.

2. An overlap connection as recited in claim 1, wherein both longitudinal rims of the oblong hole are provided with a hooklike constriction, the constrictions being mirror images of one another.

3. An overlap connection as recited in claim 2, wherein each constriction consists of a stop shoulder oriented transversely to the longitudinal direction of the oblong hole and a diverging intake flank extending from the stop shoulder to the opening at the enlarged section of the platelike part.

4. An overlapping connection as recited in claim 3, wherein the bridging extension has a T-shaped cross section provided with a necked-in section of rectangular cross section which is slidable lengthwise when inserted in the oblong hole.

5. An overlap connection as recited in claim 4, wherein the spacing between the diverging intake flanks of the mouth opening is slightly greater than the width of the necked-in section while the spacing in the region of the stop shoulders is smaller than the width of this necked-in section and the width of the oblong hole.

6. An overlap connection as recited in claim 5, wherein the second platelike part displaying the bridging extension is constructed in one piece by a method chosen from the group consisting of metal die casting and plastic injection molding.

7. An overlap connection as recited in claim 5, wherein the first platelike part which displays the bridging extension is made in one piece by die stamping out of a precut sheet metal blank.

8. An overlap connection as recited in claim 5, wherein the platelike part which displays the bridging extension is provided with a stud-like elevation on the underside at at least two diagonally opposite corners adapted to act together with the lateral projections of the bridging extension as clamping bodies when acting simultaneously on the platelike part having the oblong hole.

* * * * *